United States Patent [19]

Pilch

[11] 4,043,470

[45] Aug. 23, 1977

[54] HITCH FOR COUPLING ALIGNMENT OF TRACTOR AND BACKHOE

[75] Inventor: John S. Pilch, Ware, Mass.

[73] Assignee: Ware Machine Service, Inc., Ware, Mass.

[21] Appl. No.: 692,014

[22] Filed: June 1, 1976

[51] Int. Cl.[2] ..... B66F 9/00

[52] U.S. Cl. ..... 214/145 A; 280/460 R; 280/477

[58] Field of Search ..... 280/477, 456 R, 456 A, 280/460 R, 461 R, 460 A, 461 A, 497; 172/272, 274; 214/145 A, 131 A

[56] References Cited

U.S. PATENT DOCUMENTS

| | | | |
|---|---|---|---|
| 3,220,487 | 11/1965 | Pilch | 172/274 |
| 3,884,425 | 10/1974 | Bailey | 172/274 |

FOREIGN PATENT DOCUMENTS

| | | | |
|---|---|---|---|
| 2,061,822 | 7/1971 | Germany | 214/131 A |

*Primary Examiner*—Joseph F. Peters, Jr.
*Assistant Examiner*—R. Schrecengost
*Attorney, Agent, or Firm*—Chapin, Neal and Dempsey

[57] ABSTRACT

Hitch for coupling together a self-propelled hauling vehicle or tractor and a separate earth moving rig or backhoe which includes hydraulic stabilizers for raising and lowering the coupling end portion of the backhoe. The tractor and backhoe are each provided with interengageable coupling elements and when the tractor and backhoe are to be hitched up they are positioned in contiguous end-to-end relationship and the coupling end of the backhoe is lowered for interengagement of respective coupling elements. The tractor has inclined laterally spaced guideways sloping downwardly one toward the other. The backhoe is provided with a guide member which extends outwardly from the coupling end of the backhoe so as to be at least partially coextensive longitudinally with the inclined guideways for engagement therewith when the tractor and backhoe are positioned in end-to-end contiguous relation. The backhoe is then lowered for coupling interengagement of their respective coupling elements. The guideways are inclined and disposed to deflect the coupling end of said backhoe laterally for coupling registration of the respective coupling elements. Coupling orientation is completed by pivotable or angular movement of the coupling end portion of the backhoe toward the tractor.

9 Claims, 11 Drawing Figures

HITCH FOR COUPLING ALIGNMENT OF TRACTOR AND BACKHOE

BACKGROUND

Heretofore, when hitching up a tractor and backhoe as described in my prior U.S. Pat. No. 3,220,487, it has been necessary to jockey the tractor back and forth until accurate alignment is achieved between the center line of the tractor and the backhoe. This procedure is usually time consuming and is particularly difficult on uneven or rough terrain.

One object of this invention is to provide an improved coupling arrangement in which vertical movement of the backhoe causes alignment between the coupling means of the hauling vehicle and the backhoe. In this connection at least the base portion of a backhoe is vertically lowered by raising the stabilizer legs for intercoupling connection to the tractor and upon being lowered the coupling end portion of the backhoe is laterally shifted into coupling alignment with the tractor.

It is a further object of this invention to provide aligning coupling arrangement of the above type in which the drag between the stabilizer legs of the backhoe and the ground or other supporting surface is substantially reduced during lateral displacement thereof.

Another object of this invention is to provide aligning coupling mechanism of the above type which is simple and economical to manufacture, while being of durable and reliable construction and easy to use.

The above and other objects and advantages of this invention will be more readily apparent from the following description and with reference to the accompanying drawings, in which.

Figure 1:
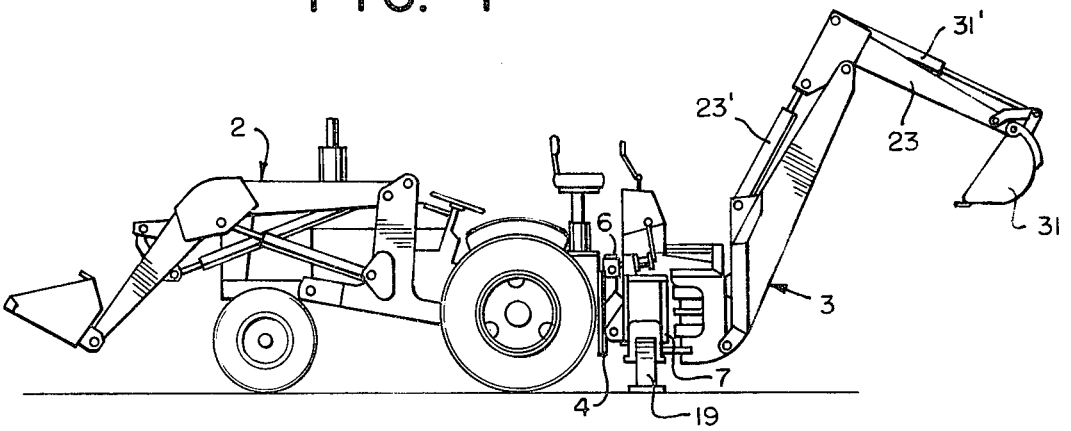
FIG. 1 is an overall elevational view showing a tractor and backhoe utilizing aligning coupling apparatus in accordance with this invention.

Referring in detail to the drawings, this invention comprises a hitch for coupling a self-propelled hauling vehicle, such as a tractor 2, and a backhoe 3 which is capable of being hauled or moved from place to place by the tractor 2.

A mounting bracket which as shown comprises a generally rectangular metal base plate 4 which may be mounted by suitable fastening means, such as bolts 5 (FIG. 2) to the coupling end of the tractor frame to be coupled to the backhoe 3. The backhoe includes a main frame 7 which as shown may have a generally planar confronting wall similar to the base plate 4 carried by the tractor 2. In general, the confronting base plates or end frames of the tractor and backhoe are each provided with releasably interengageable coupling elements, best illustrated in FIG. 2. Coupling engagement is achieved by downward and pivotable or tilting movement of the main frame 24 of the backhoe relative to the coupling end frame of the tractor. Disengagement is accomplished by tilting movement of the coupling end of the backhoe, such as by moving its dipper stick 23 which is controlled by hydraulic dipper stick cylinder 23' or its bucket 31 controlled by hydraulic bucket cylinder 31', followed by upward uncoupling movement, as will hereinafter be more fully described.

Figure 6:
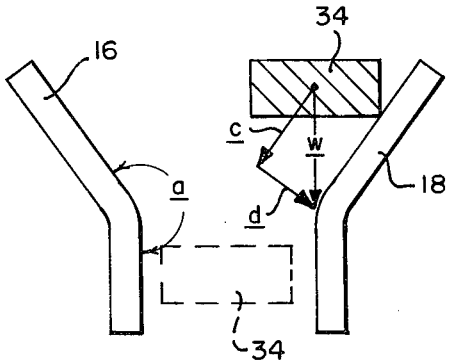
FIG. 6 is a diagrammatical elevational view illustrative of the alignment forces involved in the operation of coupling apparatus embodying this invention.

The tractor mounting bracket includes coupling connector elements adjacent the upper edge of the plate 4, indicated generally at 6 and 8 and a pair of coupling brackets 10 and 12 is disposed adjacent the lower edge of the plate 4. As shown, the latter brackets are located below the upper coupling connector elements. Located on the mounting plate 4 between the brackets 10 and 12 is an alignment guide, shown generally at 14, which comprises laterally spaced bars or plates 16 or 18 of angular configuration. The lower end portions of these guideway plates adjacent the lower edge of the plate 4 are mutually parallel and from the upper ends of the parallel wall portions each is inclined outwardly and upwardly at an oblique angle *a* less than 270° (FIG. 6). The guide plates are affixed along their inner edge to the base 4, such as by welding and each terminates outwardly of the base 4 along an open edge. The inclined upper portions of the bars cooperatively function with a guide member 34 which, as shown, is a block or lug, and extends outwardly from the frame 7 of the backhoe 3.

Figure 4:
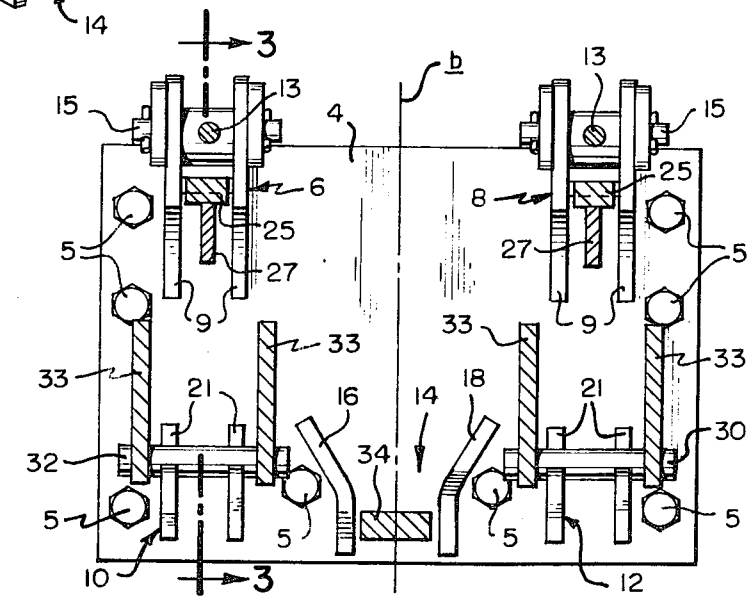
FIG. 4 is a section taken along line 4—4 of FIG. 3.

The diverging or inclined upper portions of the angled plates 16 and 18 extend outwardly of the vertical plane or axis of coupling alignment represented at *b* in FIG. 4, which in the illustrated embodiment also represents the plane of symmetry of the various coupling elements provided on the coupling end frames of the tractor and backhoe. While in the embodiment shown, the coupling axes of the tractor and backhoe correspond with the longitudinal axes or center lines of the tractor and backhoe, it should be understood this symmetrical arrangement is not essential. The significant feature of this invention is utilization of vertical movement of the coupling end portion of the backhoe obtained by raising its hydraulic stabilizers or support legs shown at 19, FIG. 2, by using hydraulic cylinders 19' to achieve lateral displacement of the coupling end of the backhoe for coupling alignment or registration of the respective coupling elements of the backhoe and tractor.

Figure 2:
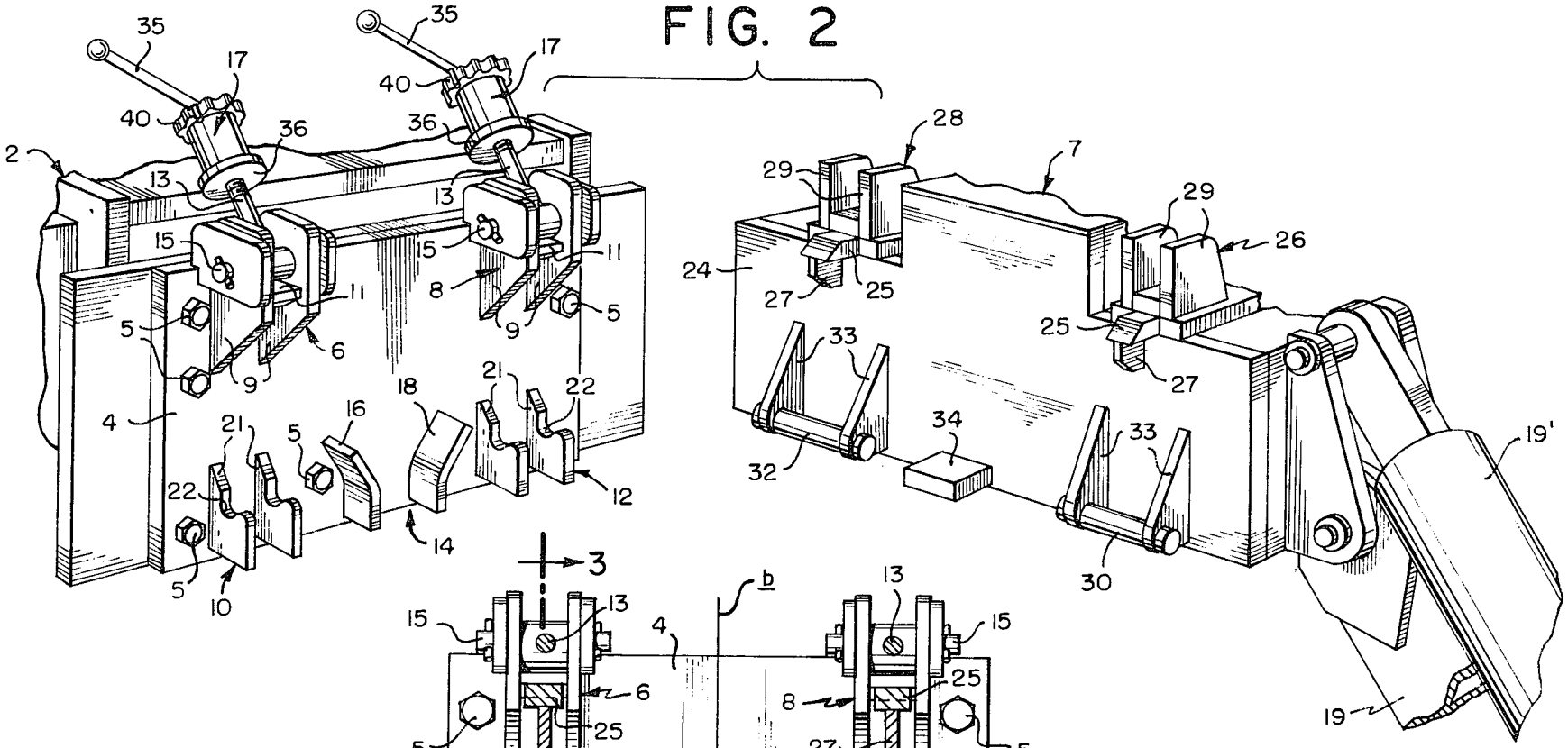
FIG. 2 is a partial perspective view showing in detail the coupling means of FIG. 1, in different operative relationship.

The main frame 7 of the backhoe comprises a generally flat plate 24 on which are mounted various coupling elements for mating interengagement with the coupling elements carried by plate 4 of the hauling vehicle. As shown in FIG. 2, latch members 26 and 28 are disposed along the upper edge of the plate 24, and are laterally spaced apart generally the same distance as connectors 6 and 8 for coupling alignment therewith, as will hereinafter be described. A pair of coupling pins or rods 30 and 32 are provided to interfit with the notched brackets 10 and 12. The guide block or lug 34 extends outwardly of the plate 24 approximately midway between the coupling pins 30 and 32 and at a distance above the lower edge of the plate so that it will be located between the parallel lower wall portions of the guide plates 16 and 18 when the pins 30 and 32 are coupled with brackets 10 and 12.

To effect coupling in accordance with this invention, the backhoe must be vertically lowered from a tilted and somewhat elevated position relative to the tractor, while the respective coupling elements on the tractor are positioned in close proximity to register with the counterpart coupling elements on the plate 24. Plate 24 of the backhoe may be lowered by raising the stabilizers 19. Upon lowering of plate 24, if the coupling axis of the backhoe is not aligned axially with the coupling axis of the tractor, guide lug 34 will engage one of the inclined vertically upper portions of guideway 14 which is open in a direction to receive the guide lug 34 which will be deflected laterally into central alignment with the parallel lower portions of the guide. As a consequence of this lateral displacement, the coupling elements of the backhoe will be shifted into registration with the coupling elements on the tractor. As will hereinafter be more fully described, coupling is thereafter completed by moving the dipper stick 23 by cylinder 23' so as to cause a tilting or pivotable movement of plate 24 for engagement of the beveled surfaces of blocks 11 with the beveled surfaces of blocks 25.

Coupling connectors 6 and 8 are generally similar in construction, each comprising a pair of vertically oriented, laterally spaced plates or bars 9 which are affixed, such as by welding, to the surface of the mounting plate 4. The inner edge of a block 11 is mounted in fixed relation on the surface of the plate 4 and its side edges abut the opposed inner surfaces of spaced plates 9. The blocks 11 are generally rectangular except that the outer lower surface of each is beveled or tapered outwardly and upwardly from the bottom surface of the block to its outer edge.

The lower outer edge portions of blocks 11 are beveled with generally the same slope as blocks 25 which are affixed to the upper edge of the backhoe's main frame 7. Blocks 25 are generally rectangular as are blocks 11 and the upper surface of each is beveled downwardly and outwardly to the outer edge of the block. The beveled surfaces of blocks 11 when engaged with the corresponding surfaces of blocks 25 serve to prevent upward movement of the main frame 7 relative to the tractor hitch and as a consequence the pins 30 and 32 are thereby held in the notches of brackets 10 and 12. In addition, when in coupled relation, the side edges of blocks 25 of the backhoe are contiguous to the inner surfaces of the upstanding plates 9 of the tractor plate 4. Thus, lateral forces to which the backhoe is subjected will to some extent be distributed by the tractor frame through plates 9 and mounting plate 4. Similarly, at a lower level guide member 34 serves the same function, since its outer edges are adjacent to the parallel lower portions of guide bars 16 and 18.

Each of the coupling connections includes a bolt 13 which is pivotably secured at its inner end on a pin 15 which extends through a hub portion of the bolt and is supported at its outer ends by the plates 9. The outer end portion of the bolt 13 is threaded and a large cylindrical nut 17 is screwed thereon.

Figure 8:
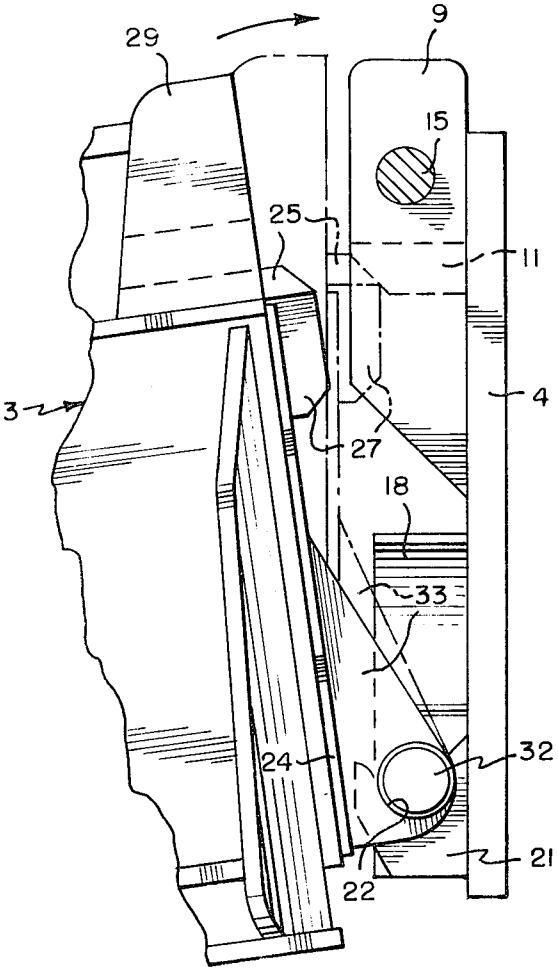
FIGS. 7 and 8 are elevational views illustrative of the steps in the coupling sequence using the apparatus of this invention.
Figure 7:
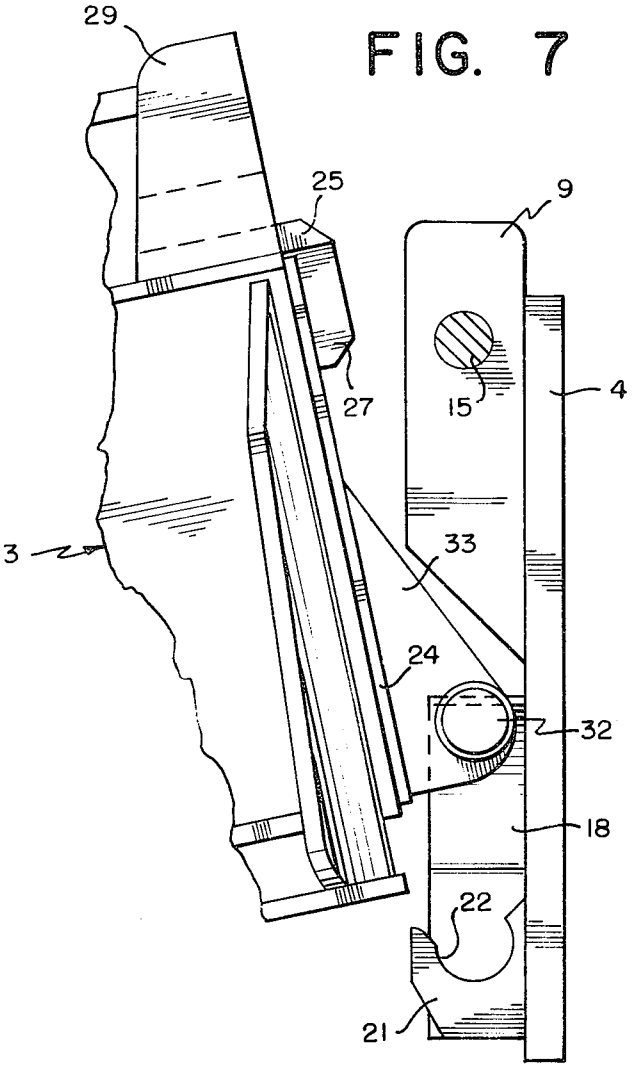

Coupling brackets 10 and 12 are generally alike and each includes a pair of laterally spaced vertically oriented plates 21 affixed along their inner edge to the outer surface of plate 4. The upper edge of each plate 21 slopes downwardly and outwardly from the plate 4 and terminates at upwardly opening notches 22 which are dimensioned to receive the pins 30 and 32 in surface-to-surface engagement. Each of the coupling pins 30 and 32 is supported adjacent its outer ends by a pair of laterally spaced, vertically oriented brackets or plates 33 which hold the pins 30 and 32 horizontal and spaced outwardly from the plate 24 and generally parallel to the plane of the plate 24. The outer ends of coupling pin support plates 33 will abut plate 24 which, as shown in FIG. 7, is the relationship when the tractor is positioned in end-to-end contiguous or abutting longitudinal coupling relation with the backhoe, whose main frame 7 has been raised or lifted by lowering stabilizers 19. The plate 24 is also shown tilted as is usual when disengaging the backhoe from a tractor after a previous operation. Upon lowering the main frame 7 by lifting the stabilizers 19 of the backhoe, the pins 30 and 32 will move vertically downward parallel to plate 4 in a direction to interfit within the upwardly opening notches 22, as shown in FIG. 8. Of course, during this vertical lowering of the pins 30 and 32 toward the notches 22, if the coupling pins are not in coupling alignment or coupling registration with the notches, the guideway 14 and guide member 34 will cause lateral displacement or movement of the backhoe coupling plate 24 into coupling registration or alignment with the tractor coupling frame or plate 4.

The guide member 34, which in the embodiment shown, is in the form of a metal bar of rectangular cross section, extends outwardly of the plate 24 a sufficient distance to be at least partially coextensive longitudinally with the inclined portions of the plates 16 and 18 of the guide channel 14 which is open to receive the guide member when the tractor and backhoe are moved longitudinally into contiguous coupling relationship.

Figure 5:
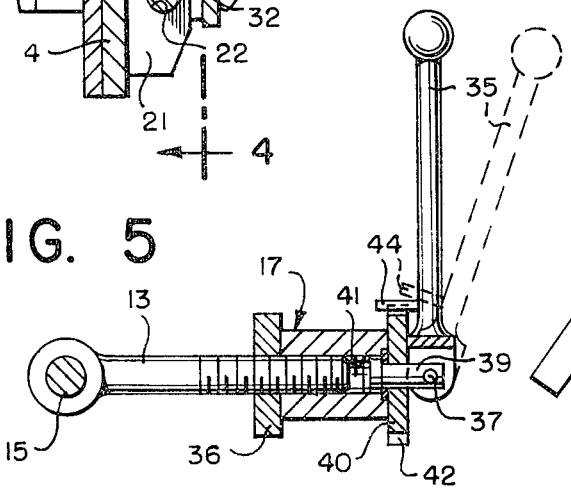
FIG. 5 is an elevational view partly in section showing a fastening element of FIG. 2 on an enlarged scale.

Tapered blocks 25 are affixed to the main frame 7 and extend outwardly of the surface of the plate 24. The blocks are reinforced by vertically disposed supports 27 affixed to the plate 24 directly below and abutting the overhanging portion of blocks 25. The inner side edge portion of each block 25 is affixed between upstanding laterally spaced latch plates 29. Each latch plate has generally straight, vertical edges. The lateral spacing between adjacent plates 29 is sufficient to enable the bolt 13 to be swung therebetween with the nut 17 being screwed outwardly so it is swung clear of the back, outer edges of the latch plates 29. When the nuts 17 are taken up, their inner end flanges 36 (FIG. 5) will be clamped against the outer edges of the latch plates 29 and lock the tractor and backhoe in coupled relation.

A ratchet type arrangement, including lever or handle 35 facilitates the tightening and loosening of nut 17. The handle 35 is pivotably attached by a pin 37 to a shaft 39 which rotatably extends through a central hole in the flange 40 on the outer end of nut 17. The shaft 39 includes an enlarged head or flange by which it is held within the internally threaded bore 41 of the nut 17. The outer peripheral edge of the flange 40 is toothed or scalloped as at 42 and a short pin 44 extends transversely from the handle 35 at a distance from its pivot pin 37 so the pin can be swung with lever 35 into engagement with the periphery of the scalloped edge of flange 40. With the pin so engaged, rotation of the handle in a plane perpendicular to the bolt 13 will be transmitted to drive nut 17. Depending upon the direction of rotation, the nut will either be tightened or loosened. Prior to tightening the nut 17 by using lever 35, it may be readily rotated by hand by grasping its large cylindrical barrel portion.

Figure 3:
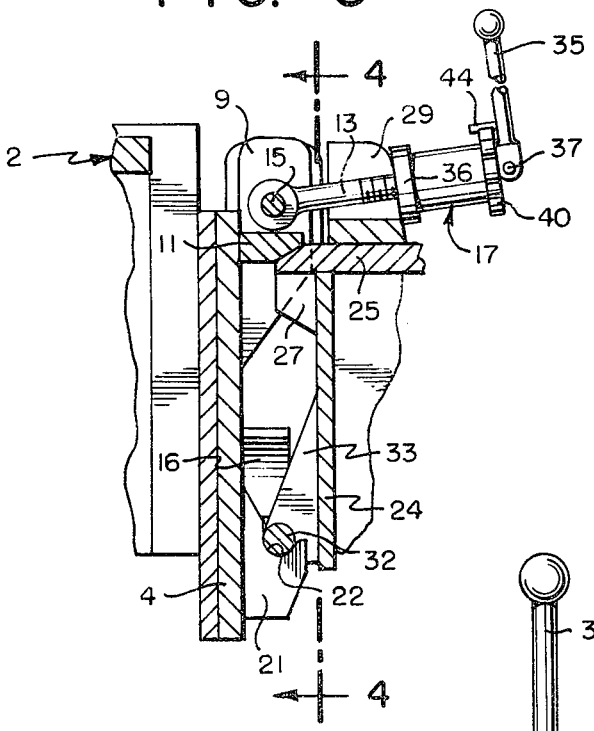
FIG. 3 is a section taken along line 3—3 of FIG. 4.

As previously mentioned, the operation of the aligning hitch embodying this invention does not mandate exact coupling alignment of the tractor and backhoe by tractor movement. The main frame of the backhoe will have been raised by lowering the hydraulic stabilizers 19 and with the bucket 31 resting in the ground the base frame 7 tilted, as shown in FIG. 7. For hitching up the backhoe, the tractor is moved into coupling proximity with the main frame of the backhoe whereby members 33 on the lower portion of the backhoe base are in firm contact with the tractor mounting plate 24. The hydraulic lines of the tractor and backhoe may now be coupled. The main frame 7 of the backhoe is then lowered by raising the stabilizer legs 19. If the backhoe and tractor are not accurately aligned for coupling registration, the guide block 34 will contact the inner surface of inclined guide plate 16 or 18 of the coupling guide, depending on whether the misalignment is left or right of coupling alignment. If it should happen by chance that the backhoe and tractor are aligned for coupling registration, the guide block 34 would simply be carried vertically downward by the main frame 7 between the lower parallel plate portions of the guideway 14. Almost invariably, however, some lateral shifting will be required to achieve coupling alignment of the tractor and the backhoe. In such cases, as the main frame 7 of the backhoe is lowered by raising its stabilizers 19, the guide block 34 will engage one of the inclined portions of the plates 16 or 18 (FIG. 6). In this condition, as the lowering of the backhoe continues, a portion of its weight represented at *w* in FIG. 6, will exert a vertically downward force on the inclined surface of guide 18. As a result of the guide surface being so inclined, the force *w* is divided into two components of force. One shown at *c,* is parallel to the inclined surface of the guide bar and the other *d* is perpendicular to the inclined plane. Component *c* thus provides a lateral alignment force, while component *d* illustrates that portion of the weight *w* of the backhoe which is supported by the tractor alignment guide 14 and mounting bracket 4 to which the guide is affixed. As a consequence, as the operator continues to lower the main frame of the backhoe, there is a substantial diminution in the weight being supported by the stabilizers 19 of the backhoe. Simultaneously, component of force *c* in the block 34 causes lateral movement of the main frame of the backhoe into coupling alignment with the tractor, i.e., the respective coupling elements or plates 4 and 24 are registered for interengagement. Lateral shifting movement of at least the backhoe base portion will continue until the block 34 reaches the lower end of the inclined portion of guide plate 16 or 18. The stabilizers 19 are lifted until the coupling pins 30 and 32 fully engage the notches 22 and whereby the coupling brackets 10 and 12 support that portion of the weight of the backhoe which was previously supported by stabilizers 19. The pins 30 and 32 and notches 22 which are interengageable when the end frames of the tractor and backhoe are in longitudinal coupling alignment provide pivot means for the tilting or angular movement of plate 24 through a vertical angle, as shown in FIG. 8. As shown, the plate 24 may be pivoted or tilted into generally parallel relation with plate 4 by using the hydraulic controls to cause movement of the bucket 31 or dipper stick 23 of the backhoe with the bucket resting against the ground or other supporting surface by using hydraulic cylinders 31' or 23' as necessary. The plate 24 is tilted to bring the upwardly beveled surfaces of block 25 into engagement with the downwardly beveled surfaces of blocks 11, as shown in FIG. 3. To complete the coupling, the operator need simply swing the fastening bolts 13 between latch plates 29 so that nuts 17 will be carried outwardly of the outer edges of the latch 29. The nuts 17 may then be taken up by hand and/or by use of levers or handles 35.

Figure 11:
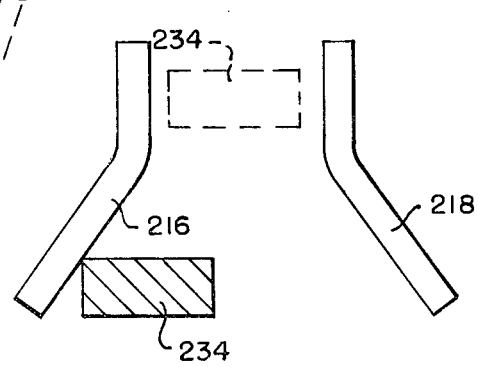
FIGS. 9, 10 and 11 are diagrammatical views similar to FIG. 6 showing three alternate embodiments of the invention.
Figure 9:
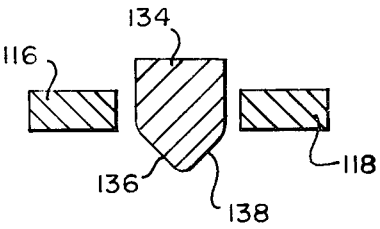
Figure 10:
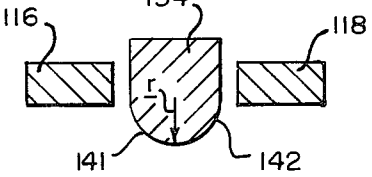

Alternative guide means are shown in FIGS. 9–11 of the drawings. In FIG. 9 is shown a guide means 134 which extends outwardly of the coupling end of the backhoe for cooperative engagement with a pair of laterally spaced alignment guide members 116 and 118 which extend outwardly of the coupling end of the tractor. The lower end portion of the block has oppositely inclined edges 136 and 138 which serve as guideways or surfaces. With the coupling end of the backhoe raised and tilted, as heretofore described, and the tractor backed into contiguous coupling relation, upon lowering of the coupling end of the backhoe, one of the inclined edges 136 or 138 will engage one of the guide members 116 or 118, depending upon the direction of misalignment. As the backhoe is lowered, its coupling end will be shifted laterally into coupling alignment with the tractor. Thereafter the coupling end of the backhoe is tilted to complete the hitch up, as previously described.

The guide means shown in FIG. 10 is generally similar to the guide means of FIG. 9, except that the lower edge of block 134' is curved. The curved lower edge of the block is composed of arcs 141 and 142 on opposite sides of the radius *r* which will engage respectively either block 116 or 118 as the backhoe is lowered to shift the coupling end of the backhoe into alignment with the tractor, as previously described. The arcs 141 and 142 may thus be seen as guideways or surfaces which though curved are functionally equivalent to the inclined surfaces 136 and 138, since tangents to the arcs 141 and 142 are inclined rectilinear surfaces as are the guideways 136 and 138 of FIG. 9 and 16 and 18 of FIG. 6.

In FIG. 11 is shown another alternative embodiment of the guide means embodying this invention. In this embodiment, a guide member or lug 234 extends outwardly of the coupling end wall of the tractor for cooperative engagement with a pair of inclined means 216 and 218. Each of the guide means 216 and 218 comprises generally laterally spaced parallel upper end portions and downwardly and outwardly inclined lower end portions. In using this embodiment, as the backhoe is lowered when not in coupling alignment with the tractor, the inclined surface of guideways or guide means 216 or 218 will engage one or the other of the upper outer edges of block 234 and cause a lateral shifting of the coupling end of the backhoe into coupling alignment with the tractor, whereby the block 234 will be received between the parallel upper end portions of the guide plates 216 and 218.

Having thus described the invention, what is claimed is:

1. Hitch for coupling and alignment of tractor-type vehicle and backhoe wherein each has an end frame with coupling means carried thereon which are interengageable when the tractor and backhoe are positioned in coupling alignment, said backhoe including stabilizer means for raising and lowering its end frame, said hitch comprising guide means on one of said end frames and a guide member on the other of said end frames, said guide means including vertically inclined surfaces which extend laterally toward each other, each inclined surface terminating along an open edge disposed to engage said guide member in at least partially coextensive longitudinal relationship when said end frames are moved toward each other longitudinally for interengagement of their respective coupling means, said guide means and guide member being adapted when engaged along one of the open edges to provide a lateral component of force upon lowering by said stabilizers of the end frame of the backhoe from a raised position and lateral misalignment relative to the tractor, said component of force serving to move the coupling end frame of the backhoe laterally into coupling alignment with the tractor said coupling means includes means for supporting and pivotably interconnecting the end frame of the backhoe to the end frame of the tractor and being disposed to interengage upon said lowering of the end frame of the backhoe in coupling alignment.

2. Hitch for coupling and alignment of tractor-type vehicle and backhoe as set forth in claim 1 in which each of said inclined surfaces slopes downwardly and inwardly toward the axis of coupling alignment of the tractor and said coupling means being separate from said guide means and guide member and including vertically interengageable portions.

3. Hitch for coupling and alignment of tractor-type vehicle and backhoe as set forth in claim 2 in which said inclined surfaces are in the form of guideways which extend outwardly of the coupling end frame of the tractor with their upper portions inclined downwardly and inwardly toward the center of coupling alignment of the tractor from points substantially outwardly thereof, said guideways having generally parallel lower end portions spaced laterally from said center of coupling alignment, the guide member carried by said backhoe being in the form of a lug dimensioned to fit between the parallel portions of said guideways when the tractor and backhoe are coupled together and serving to retain said tractor and backhoe in coupled alignment.

4. Hitch for coupling and alignment of tractor-type vehicle and backhoe as set forth in claim 2 in which the pivotable interconnecting means comprises at least one bracket carried by the tractor and at least one coupling pin carried by said backhoe, said bracket having an upwardly opening notch, said coupling pin being disposed to interengage said notch when the backhoe is lowered to coupling engagement with said tractor.

5. Hitch for coupling and alignment of tractor-type vehicle and backhoe as set forth in claim 4 in which each of said coupling end frames includes at least one beveled surface disposed above the level of engagement of said coupling pin and notch, the beveled surfaces sloping in the opposite direction and being interengageable when the tractor and backhoe are hitched together for retaining said coupling pin and notch in coupled relation.

6. Hitch for coupling and alignment of tractor-type vehicle and backhoe as set forth in claim 4 in which one of said coupling end frames includes at least one pivotable fastening bolt and the other includes spaced plates for receiving the bolt therebetween, the outer end of said bolt having a nut threaded thereon to fasten said tractor and backhoe in coupled relation.

7. Hitch for coupling and alignment of tractor-type vehicle and backhoe as set forth in claim 5 in which one of said beveled surfaces is formed on a block affixed to the end frame of the tractor and the other is on a block affixed to the end frame of said backhoe, the block on one end frame extending between a pair of spaced plates on the other end frame when the two frames are in coupled relation, said plates limiting the relative lateral movement of the block and thereby tending to maintain the backhoe and tractor in coupled alignment.

8. Hitch for coupling and alignment of tractor-type vehicle and backhoe as set forth in claim 6 in which the nut on said pivotable bolt has a scalloped periphery and includes a pivotable drive lever which extends outwardly of said nut and is rotatably connected thereto, said lever including a projection to drivingly engage the scalloped periphery to rotate said nut for securely fastening said vehicles in coupled relation.

9. Method of aligning and hitching together a tractor having hydraulic lines and a backhoe having hydraulically operated stabilizer legs, each having a coupling end frame with interengageable coupling elements thereon, the end frame of the backhoe being raised and tilted relative to the end frame of the tractor, one of said end frames being provided with laterally extending vertically inclined guide surfaces each of which terminate along an open edge facing rearwardly and the other end frame having a guide member disposed to engage one of said guide surfaces along said open edge when the end frames are misaligned in contiguous coupling relation, moving the tractor to position its end frame in contiguous coupling relation with the end frame of the backhoe, coupling the hydraulic lines of the tractor to the backhoe, vertically lowering the coupling end frame of the backhoe relative to the tractor by raising the stabilizer legs of the backhoe, thereby, as a result of engagement of the guide member and one of said inclined guide surfaces, shifting a portion of the weight from said stabilizer legs to the end frame of the tractor to provide a lateral component of aligning force for moving the end frame of the backhoe into coupling alignment with the tractor, said component of force being a function of that portion of the weight shifted to the end frame of the tractor and thereafter tilting the end frame of said backhoe into final coupling relation with the end frame of the tractor said coupling elements being vertically interengageable upon lowering the end frame of the backhoe by fully raising the stabilizer legs so they no longer support the backhoe end frame.

* * * * *